US010843320B2

(12) United States Patent
Bodin et al.

(10) Patent No.: US 10,843,320 B2
(45) Date of Patent: Nov. 24, 2020

(54) COMBINED FIXING TOOL

(71) Applicant: Illinois Tool Works Inc., Glenview, IL (US)

(72) Inventors: Christophe Bodin, Glenview, IL (US); Alain Vettoretti, Glenview, IL (US); Frédéric Nayrac, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 155 days.

(21) Appl. No.: 15/969,096

(22) Filed: May 2, 2018

(65) Prior Publication Data

US 2018/0318996 A1 Nov. 8, 2018

(30) Foreign Application Priority Data

May 5, 2017 (EP) ..... 17169626

(51) Int. Cl.
*B25C 7/00* (2006.01)
*B25C 1/18* (2006.01)
*B25C 1/00* (2006.01)

(52) U.S. Cl.
CPC ..... *B25C 7/00* (2013.01); *B25C 1/003* (2013.01); *B25C 1/18* (2013.01); *B25C 1/188* (2013.01); *B25C 1/008* (2013.01)

(58) Field of Classification Search
CPC ..... B25C 5/1658; B25C 5/1651; B25C 1/001; B25C 1/005
See application file for complete search history.

(56) References Cited

U.S. PATENT DOCUMENTS

| | | | | |
|---|---|---|---|---|
| 3,633,811 | A | 1/1972 | Ploen | |
| 3,708,095 | A | 1/1973 | Briggs | |
| 5,437,404 | A * | 8/1995 | Shkolnikov | B25C 1/184 227/109 |
| 6,880,739 | B1 | 4/2005 | Zhu | |
| 2003/0218044 | A1* | 11/2003 | Laubach | B25C 1/005 227/109 |
| 2005/0121488 | A1* | 6/2005 | Sun | B25C 1/005 227/109 |
| 2008/0128468 | A1 | 6/2008 | Lee | |
| 2009/0050667 | A1 | 2/2009 | Po | |
| 2011/0114695 | A1 | 5/2011 | Yang et al. | |
| 2012/0187176 | A1* | 7/2012 | Wu | B25C 1/005 227/120 |

(Continued)

FOREIGN PATENT DOCUMENTS

| | | | |
|---|---|---|---|
| DE | 29503642 | U | 6/1995 |
| WO | 2005105383 | A1 | 11/2005 |

OTHER PUBLICATIONS

European Search Report from European Application No. EP 17169626.3, dated Jan. 19, 2018 (9 pages).

(Continued)

*Primary Examiner* — Praachi M Pathak
(74) *Attorney, Agent, or Firm* — Neal, Gerber & Eisenberg LLP

(57) ABSTRACT

A fixing tool including a nose for guiding of fixing elements and a striking plate for striking of the fixing elements, wherein the fixing tool is configured to fire a fixing element of a first type and a fixing element of a second type with dimensional and/or geometric characteristics which are different from those of the fixing element of the first type.

18 Claims, 7 Drawing Sheets

(56) References Cited

U.S. PATENT DOCUMENTS

2013/0320062 A1* 12/2013 Segura ..... B25C 1/001
227/109
2018/0318993 A1* 11/2018 Bodin ..... B25C 1/003

OTHER PUBLICATIONS

Examination Report No. 1 from Australian Application No. AU 2018/203040 dated Mar. 2, 2019 (4 pages).
Examination Report No. 2 from Australian Application No. AU 2018/203040 dated Jul. 3, 2019 (4 pages).
Requisition by the Examiner from Canadian Application No. CA 3002934, dated Apr. 2, 2019 (5 pages).
Requisition by the Examiner from Canadian Application No. CA 3002934, dated Dec. 16, 2019 (3 pages).
First Examination Report from New Zealand Application No. NZ 742142, dated Jul. 30, 2018 (6 pages).

* cited by examiner

COMBINED FIXING TOOL

PRIORITY

This application claims priority to and the benefit of EP Application No. 17169626.3, filed May 5, 2017, the entire contents of which is incorporated herein by reference.

TECHNICAL FIELD

The present disclosure relates to a fixing tool that is configured to fire fixing elements of a first type and fixing elements of at least a second type with dimensional and/or geometric characteristics that are different from those of the fixing elements of the first type.

BACKGROUND

Sealing or fixing tools are tools that make it possible to drive a fixing element (such as a staple, nail, tack, pin, etc.) into a support material (which in particular is made of wood, concrete, or steel). For this purpose, a plate in motion strikes a fixing element (for example, on the head in the case of a nail) that is present in a firing chamber, in order to launch the fixing element so that it can be anchored in the support material. The plate is put into motion by a drive device that uses, for example, thermal and/or electrical and/or pneumatic energy.

In general, a tool of this type comprises a nose (also known as a tip guide) and a shearing block (also known as a connector), delimiting the firing chamber on the inside. The shearing block forms an integral part of a store that is fitted supported, in a detachable manner, on the nose of the tool. The fixing elements which are stored in the store are introduced one by one into the firing chamber through a supply window provided in the shearing block.

In the case of a tool of the nail driver type, a refill is generally in the form of a strip of nails, the nails being adjacent to one another and retained in position by appropriate mechanisms such as adhesive strips.

Depending on the applications, the nails have different characteristics, particularly as far as the dimensions, geometry and mechanical properties are concerned.

By way of example, in association with the geometry of a nail, the head can in particular have a form that is round or in the shape of a "D". The shank can be centered or off-centered relative to the head. The shank can in particular be smooth, notched, or twisted.

By way of example, in association with the mechanical properties, the nail can be subjected to different heat treatments (such as quenching, tempering, and annealing) in the mass or on the surface, in particular in order to improve its mechanical properties (such as resistance to breakage, yield point, hardness).

It will also be noted that, depending on the nails, and in particular according to the form of the head, the strip is more or less dense, and in other words the number of nails varies on a strip of the same size.

Conventionally, a fixing tool is associated with a type of nail. In fact, according to the type of nail used, several components of the tool have different designs. Amongst these components there are in particular the nose, the plate, and the shearing block.

In fact, irrespective of the type of nail, in order to obtain high-quality firing repeatedly, a plurality of technical constraints must be complied with, amongst which reference can be made to:

- accurate striking of the head of the nail by the plate, in order in particular to prevent double firing (simultaneous projection of two nails) and to limit the friction forces; and
- accurate guiding of the nail in the firing chamber, so that the trajectory of the nail output from the chamber substantially coincides with the direction of the plate.

One advantage of the present disclosure is in particular to provide a fixing tool that makes it possible to fire fixing elements of different types (i.e., that in particular have different dimensional and/or geometric characteristics).

SUMMARY

According to a first aspect, the present disclosure relates to a nose for guiding of fixing elements for a fixing tool, such as a nail driver, characterised in that the nose is configured to fire a fixing element of a first type and a fixing element of at least a second type with dimensional and/or geometric characteristics that are different from those of the fixing element of the first type, with the nose comprising locations, in particular heads, which are distinct from the fixing elements of the first and second type.

A nose of this type makes it possible to position the fixing elements of the first type and the second type accurately relative to a striking plate in a firing chamber. Positioning of this type limits significantly the double firings (i.e., firing of two fixing elements simultaneously) and the friction forces induced on the fixing element fired, whilst optimising the precision of firing.

The nose according to the present disclosure can comprise one or a plurality of the following characteristics, taken in isolation from one another or in combination with one another:

- the geometric and/or dimensional characteristics of the heads of the fixing elements of the first type and second type are different;
- the relative position of the shank in relation to the head of the fixing elements of the first type and the second type is different;
- the nose delimits at least part of a firing chamber and comprises:
  - a first support area that can cooperate with a head of the fixing element of the first type, for the purpose of its positioning before firing;
  - a second support area, which is spaced from the first area, and can cooperate with a head of the fixing element of the second type for the purpose of its positioning before firing;
- the nose comprises a stepped wall that defines the first and second support areas;
- the first and second support areas are aligned according to an axis of extension of the stepped wall;
- the nose comprises a rim that can engage in a groove in a striking plate of a fixing element of a fixing tool;
- the rim is supported by the stepped wall;
- the rim defines the first support area; and/or
- the first and second support areas are concave, and for example cylindrical.

According to a second aspect, the present disclosure also relates to a striking plate of a fixing element for a fixing tool, such as a nail driver, characterised in that the striking plate is configured to drive a fixing element of a first type, and at least one fixing element of a second type with dimensional and/or geometric characteristics that are different from those of the fixing element of the first type, with the striking plate comprising a striking surface that is configured to strike in particular heads of the fixing elements that are placed respectively in distinct locations of a nose for guiding of the tool.

A striking plate of this type makes it possible to strike the fixing elements of the first type and the second type with precision, with the striking plate adapting in particular to the refilling, and more specifically to the arrangement of the fixing elements relative to one another. Striking of this type limits the double firings and friction forces induced on the fixing element fired, whilst optimising the precision of firing.

The striking plate according to the present disclosure can comprise one or a plurality of the following characteristics, taken in isolation from one another or in combination with one another:

- the geometric and/or dimensional characteristics of the heads of the fixing elements of the first type and second type are different;
- the relative position of the shank in relation to the head of the fixing elements of the first type and second type is different;
- the striking plate has a generally elongate form and is symmetrical according to a longitudinal plane, the plate comprising:
  - a mechanism for fixing on a drive device, that is/are situated at a first longitudinal end;
  - the striking surface of a head of the fixing elements of the first type and the second type, the striking surface being situated at a second longitudinal end opposite the first end;
  - an elongate body situated between the first end and the second end, with the body being able to slide in a firing chamber in which the fixing element of the first type or of the second type to be struck is located;
- the body comprising at least one longitudinal groove that can receive a rim of a nose for guiding of fixing elements of a fixing tool;
- the groove is centered relative to the plane on an upper face of the body, and extends longitudinally from a position near the first longitudinal end toward and through the striking surface of the plate at the second longitudinal end;
- the striking plate comprises at least a first recess opposite the groove, with the recess being able to receive a tongue projecting from a shearing block of a fixing tool;
- the recess opens at the same time onto a flank, a lower face, and the striking surface of the plate;
- the striking plate comprises a second recess that is symmetrical with the first recess according to the plane;
- the upper face and the striking surface are connected via at least one upper chamfer;
- the lower face and the striking face are connected by at least one lower chamfer.

According to a third aspect, the present disclosure relates to a shearing block of a store fitted supported on the nose of a fixing tool according to a joining plane, the shearing block comprising at least one guide track of the fixing element of the first type and/or of the fixing element of the second type, the track being opposite the first and second support areas.

A shearing block of this type makes it possible to guide the fixing element fired precisely, so that the element does not come into contact with the fixing element situated just below, whilst stabilising the trajectory of the fixing element fired, to the benefit of the precision of firing.

The shearing block according to the present disclosure can comprise one or a plurality of the following characteristics, taken in isolation from one another or in combination with one another:

- the shearing block comprises a central window for supply to the chamber, with the window extending according to the axis and opening into the chamber;
- the guide track is formed by two notches for guiding of the head of the fixing element of the first type and/or of the head of the fixing element of the second type, with the notches being opposite one another and bordering the window at least partly;
- the guide track projects inside the chamber, relative to the joining plane;
- the shearing block comprises at least one tongue projecting relative to the joining plane, and in which one of the two notches is formed, the tongue being able to engage in at least one recess in the plate.

According to a fourth aspect, the present disclosure relates to a fixing tool comprising a nose as previously described and/or a plate as previously described. This fixing tool is configured to fire a fixing element of a first type and at least one fixing element of a second type with dimensional and/or geometric characteristics different from those of the fixing element of the first type.

A so-called polyvalent (or combined) fixing tool of this type enables a user to fire fixing elements of different types configured for different applications, to the benefit in particular of productivity.

The tool according to the present disclosure can comprise one or a plurality of the following characteristics, taken in isolation from one another or in combination with one another:

- the geometric and/or dimensional characteristics of the heads of the fixing elements of the first type and the second type are different;
- the relative position of the shank in relation to the head of the fixing elements of the first type and the second type is different;
- the nose delimits at least partly a firing chamber, the nose comprising a first support area that can cooperate with a head of the fixing element of the first type, for the purpose of its positioning before firing, and at least a second support area, that is spaced from the first area, and can cooperate with a head of the fixing element of the second type for the purpose of its positioning before firing;
- the striking plate is mobile in translation relative to the nose according to an axis, the plate being able to strike a head of the fixing elements of the first type and of the second type;
- the tool comprises a store comprising a shearing block fitted supported on the nose according to a joining plane, with the shearing block comprising at least one guide track of the fixing element of the first type and/or of the fixing element of the second type, the track being opposite the first and second support areas;
- the shearing block comprises a central window for supply to the chamber, with the window extending according to the axis and opening into the chamber;
- the guide track is formed by two notches for guiding of the head of the fixing element of the first type and/or of the head of the fixing element of the second type, the notches being opposite one another and bordering the window at least partly;
- the guide track projects inside the chamber relative to the joining plane;

the shearing block comprises at least one tongue projecting relative to the joining plane, and in which one of the two notches is formed, the tongue being able to engage in at least one recess in the plate; and the striking plate comprises a groove which extends according to the axis, and can receive a rim of the nose.

BRIEF DESCRIPTION OF THE FIGURES

The present disclosure will be better understood, and other details, characteristics and advantages of the present disclosure will become more apparent from reading the following description, provided by way of non-limiting example and with reference to the appended drawings, in which.

DETAILED DESCRIPTION

Figure 1:
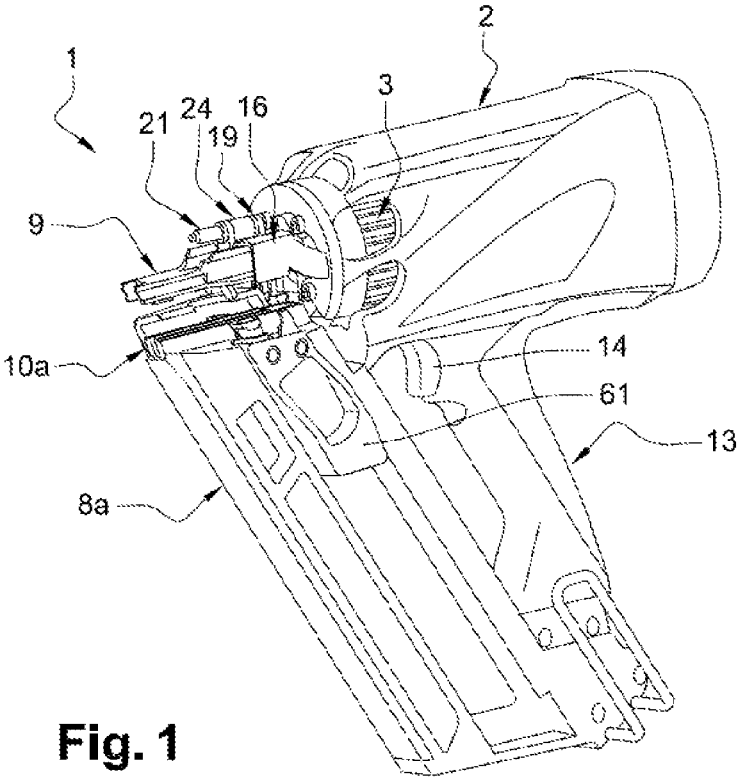
FIG. 1 is a view in perspective of an example fixing tool according to one embodiment of the present disclosure, illustrating in particular the fitting of a store on a nose of the tool.

While the features, methods, devices, and systems described herein may be embodied in various forms, there are shown in the drawings, and will hereinafter be described, some exemplary and non-limiting embodiments. Not all of the depicted components described in this disclosure may be required, however, and some implementations may include additional, different, or fewer components from those expressly described in this disclosure. Variations in the arrangement and type of the components; the shapes, sizes, and materials of the components; and the manners of attachment and connections of the components may be made without departing from the spirit or scope of the claims as set forth herein. This specification is intended to be taken as a whole and interpreted in accordance with the principles of the disclosure as taught herein and understood by one of ordinary skill in the art. The drawings are not to scale unless noted otherwise.

The example fixing tool 1 represented in FIG. 1 is in the present case a nail driver 1. The tool 1 comprises a housing 2 containing a drive device 3 that is configured to put into motion a plate 4 according to a longitudinal axis X. In this case, the plate 4 can strike a head 5*a* or 5*b* of a nail 6*a* or 6*b*, respectively, that is present in a firing chamber 7, and is extracted from a supply store 8*a* or 8*b* in order to launch this nail 6*a*, 6*b* so that it can be anchored in a support material.

At the front of the housing 2, a nose 9 and a shearing block 10*a* or 10*b* delimit on the inside the firing chamber 7 and a mouth 11 through which the nail 6*a* or 6*b* leaves the chamber 7. The shearing block 10*a* or 10*b* forms an integral part of the store 8*a* or 8*b*, respectively, that is fitted supported, detachably, on the nose 9 of the tool 1. The nails 6*a* or 6*b* that are stored in the store 8*a* or 8*b* are introduced one by one into the firing chamber 7 through a supply window 12 that is provided in the shearing block 10*a* or 10*b*.

The tool 1 additionally comprises a grasping and manipulation handle 13 formed by the housing 2. An actuation trigger 14, placed in the top part of the handle 13, enables the user to initiate the firing, generally provided that a sensor 15*a* or 15*b* is engaged.

The sensor 15*a* or 15*b* forms an integral part of an assembly known as the "sensor assembly" which is fitted in particular such as to be mobile in translation relative to the nose 9 of the tool 1. The sensor assembly and the trigger 14 are complementary mechanisms that enable the user to initiate the firing in complete safety.

More specifically, the sensor 15*a* or 15*b* enables the user to aim the location of the nail 6*a* or 6*b* on the support material by bringing the sensor 15*a* or 15*b* into contact with the latter. The sensor assembly additionally comprises an armature 16 comprising a central head 17 that is fitted such as to be mobile on the nose 9 of the tool 1, and two branches 18 that overlap the drive device 3, with each branch 18 extending from the head 17, and being connected to the drive device 3 at its free end. The sensor assembly also comprises a device for regulation of the penetration of the sensor 15*a* or 15*b*. The regulation device comprises a cap 19 that is secured on the head 17 of the armature 16 via two rivets 20 and a shaft 21 comprising:

a first threaded portion 22 on which the sensor 15*a* or 15*b* is fitted; and a second portion 23 on which a knurling wheel 24 is pinned, with the second portion 23 being fitted such as to be mobile in rotation relative to the cap 19.

The rotation of the knurling wheel 24 by the user thus makes it possible to regulate the penetration of the sensor 15*a* or 15*b*.

According to the present disclosure, the tool 1 is configured to fire a nail of a first type 6*a* (represented in FIG. 3), and at least one nail of a second type 6*b* (represented in FIG. 4), with dimensional and/or geometric characteristics which are different from those of the nail of the first type 6*a*.

Thus, as described in the continuation of the description, in order to go from one application to another (and in other words go from the first type of nail 6*a* to the second type of nail 6*b* or conversely), the user needs to change at the most only the supply store 8*a* or 8*b* and the sensor 15*a* or 15*b*.

Figure 3:
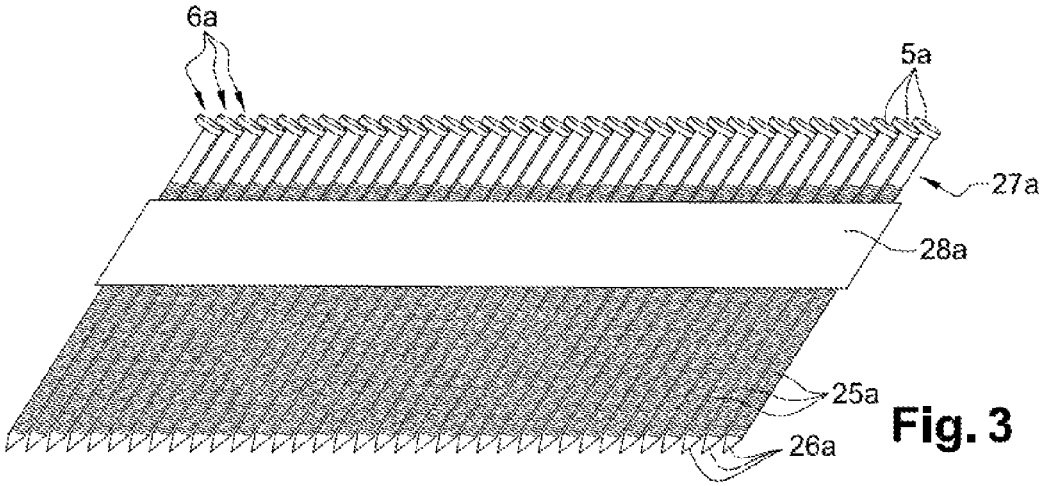
FIG. 3 is a front view of a refill of a first type of nail configured to be inserted in the store of the tool.
Figure 4:
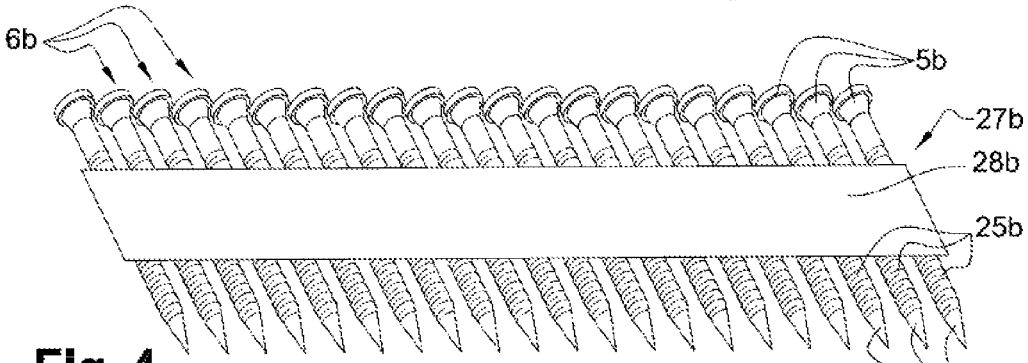
FIG. 4 is a front view of a refill of a second type of nail configured to be inserted in the store of the tool.

In the continuation of the description, and according to the example represented in the figures, the first type of nail 6*a* known as a "B/B nail" (for Wood on Wood) is represented in FIG. 3, and the second type of nail 6*b* known as a "M/B" nail (for Metal on Wood) is represented in FIG. 4.

The B/B nail 6*a* is thus configured to fix a first wooden element on a second wooden element. The wooden elements are, for example, battens, laths, cross-laths, roof laths, etc.

The B/B nail 6*a* represented in FIG. 3 is a nail known by the registered trademark RounDrive®. A B/B nail 6*a* of this type has in particular the following technical characteristics:

- a round head 5*a;*
- a shank 25*a* which is off-centered relative to the head 5*a*, and is mostly notched;
- a tip 26*a* with four inclined planes; and
- the nail 6*a* is made of steel, which for example is galvanised.

A B/B nail 6*a* of this type makes it possible to have a large number of B/B nails 6*a* per refill 26*a*. As illustrated in FIG. 3, a refill 26*a* is in the form of a strip of nails 6*a*, with the nails 6*a* being adjacent to one another with a constant pitch, and retained in position by adhesive paper strips 28*a*. The B/B nails 6*a* are inclined relative to the direction of extension of the adhesive strips 28*a*.

The M/B nail 6*b* is thus configured to fix a first metal element on a wooden element. The metal element is, for example, a connector, a shoe, an angle iron, etc. As previously stated, the wooden element is, for example, a batten, a lath, a cross-lath, a roof lath, etc. The M/B nail 6*b* represented in FIG. 4 has in particular the following technical characteristics:

- a round head 5*b;*
- a shank 25*b* which is centered relative to the head 5*b*, and is mostly notched;
- a tip 26*b* with four inclined planes; and
- the nail 6*b* is made of quenched steel, which for example is galvanised.

In comparison with a refill 26*a* of B/B nails 6*a*, the density of M/B nails 6*b* in a refill 26*b* is lower. In the same manner as for the B/B nails 6*a*, the M/B nails 6*b* are adjacent to one another with a constant pitch, and retained in position by adhesive paper strips 28*b*, with the M/B nails 6*b* also being inclined relative to the direction of extension of the adhesive strips 28*b*.

As described above and illustrated in FIGS. 3 and 4, a B/B nail 6*a* and an M/B nail 6*b* have in particular different dimensional and/or geometric characteristics. In the present case, in order to go from one application to another (and in other words go from the B/B nail 6*a* to the M/B nail 6*b* or conversely), the user only needs to change the supply store 8*a* or 8*b* and the sensor 15*a* or 15*b*.

Thus, in the continuation of the description, for the B/B nails 6*a* reference will be made to the B/B store 8*a* and the B/B sensor 15*a*. Similarly, for the M/B nails 6*b*, reference will be made to the M/B store 8*b* and the M/B sensor 15*b*.

It should also be noted that the mechanical properties of the B/B nails 6*a* and the M/B nails 6*b* are different. The quenching of the M/B nail 6*b* enable it to have in particular resistance to breakage, a yield point and a hardness which are greater than those of the B/B nail 6*a*.

Figure 6:
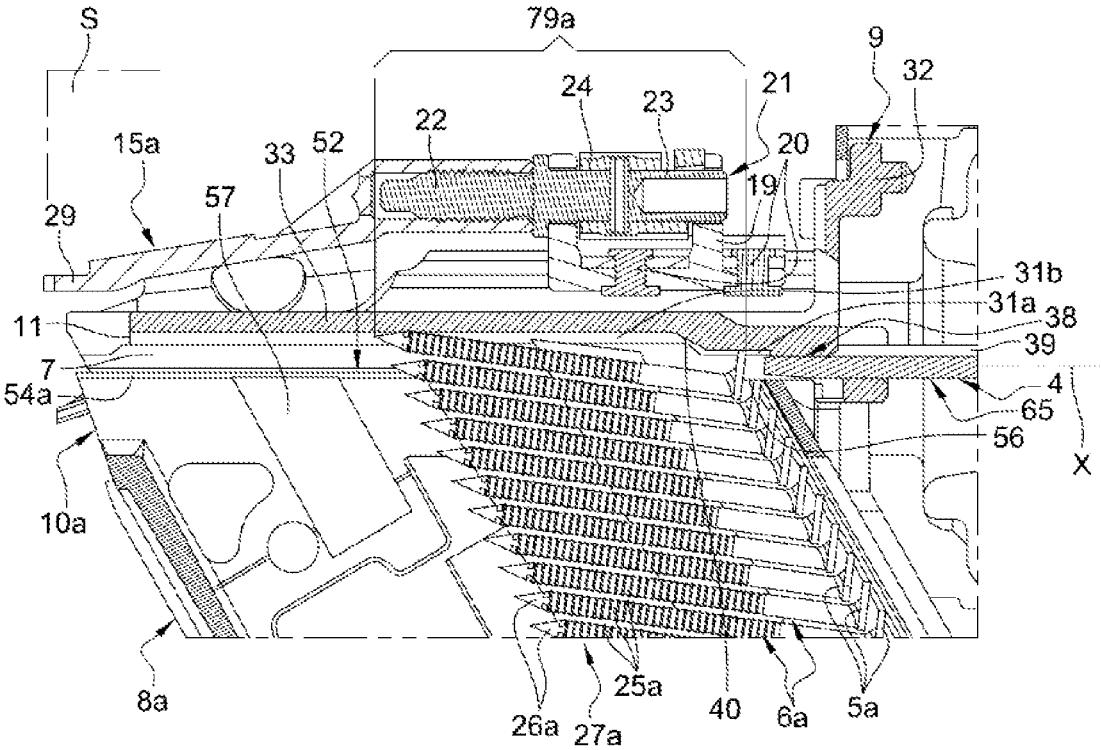
FIGS. 6 and 7 are respectively views in longitudinal and transverse cross-section of the fixing tool on which there is fitted the store configured for the first type of nail, in a so-called "before firing" position.
Figure 8:
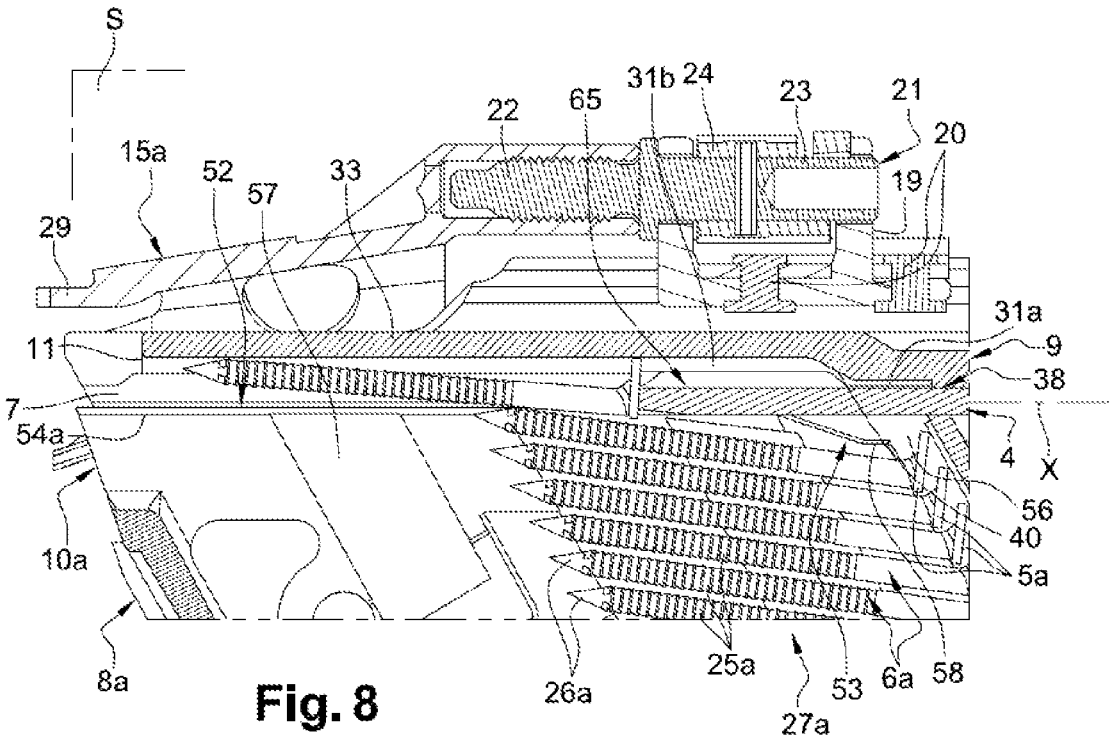
FIGS. 8 and 9 are respectively views in longitudinal and transverse cross-section of the fixing tool on which there is fitted the store configured for the first type of nail, in a so-called "during firing" position.

As illustrated in FIGS. 6 and 8, the B/B sensor 15*a* comprises a front end in the form of a "U" provided with a plurality of pins 29 that are configured to come into contact with the support material.

Figure 10:
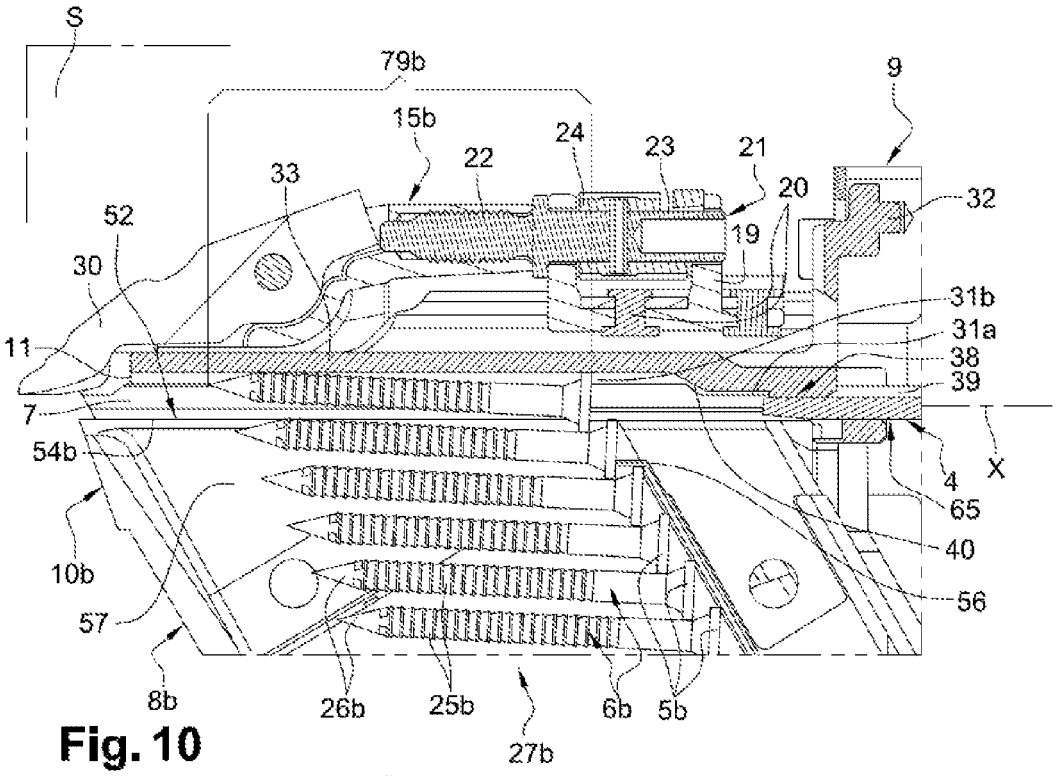
FIGS. 10 and 11 are respectively views in longitudinal and transverse cross-section of the fixing tool on which there is fitted the store configured for the second type of nail, in a "before firing" position.
Figure 12:
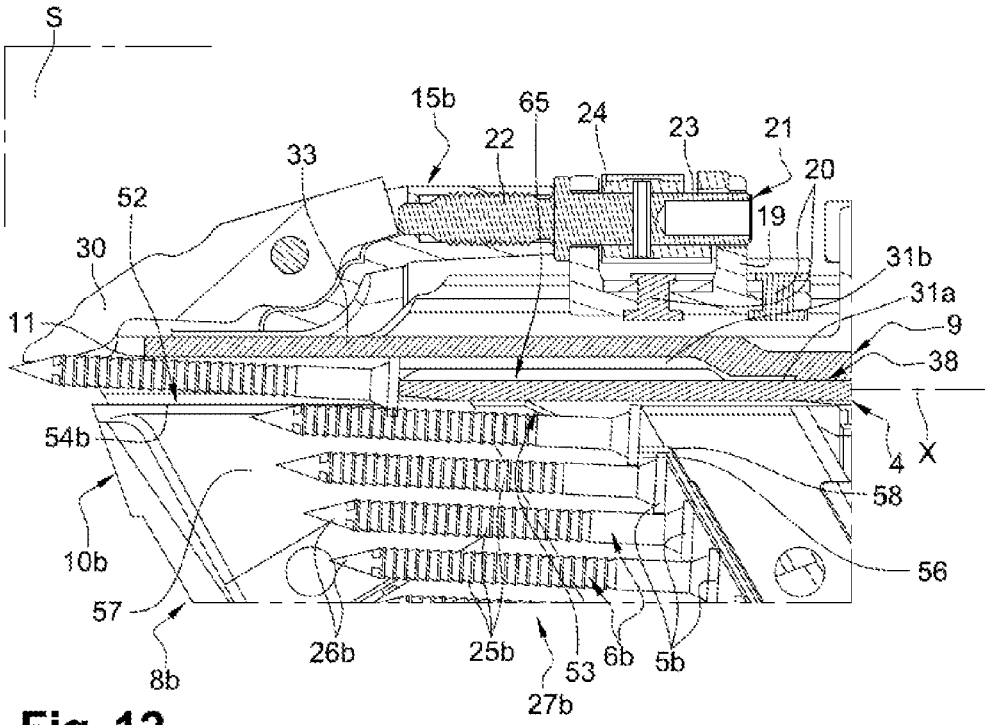
FIGS. 12 and 13 are respectively views in longitudinal and transverse cross-section of the fixing tool on which there is fitted the store configured for the second type of nail in a "during firing" position.

As illustrated in FIGS. 10 and 12, the M/B sensor 15*b* comprises a centering unit 30 that is fitted on return mechanisms. In use, upstream from the firing, the user positions the centering unit 30 in a hole in the metal element to be fixed. Then, during the firing, the centering unit 30 draws aside in order to enable the M/B nail 6*b* to pass. An M/B sensor 15*b* of this type makes it possible to fire the M/B nail 6*b* precisely through the required hole in the metal element.

The drive device 3 can put the plate 4 into motion according to the axis X on the basis of thermal and/or pneumatic and/or electrical energy.

According to the embodiment illustrated in the figures, the drive device 3 is a thermal engine. In the present case, the plate 4 is fixed to a piston which is mobile in a combustion chamber. The piston is put into motion by the combustion of a mixture of air and gas obtained from a cartridge fitted in the tool 1.

A description will now be provided of the different aspects of the present disclosure that can be incorporated, independently from one another or in combination with one another, in the tool 1 in FIG. 1.

In the fitted position, the nose 9, the shearing block 10*a* or 10*b* and the plate 4 have a common plane of symmetry known as S that passes in particular through the longitudinal axis X.

By convention, the following directions are defined relative to the tool 1:

- a longitudinal horizontal direction that coincides with the axis X;
- a transverse horizontal direction, defined by an axis perpendicular to the plane S; and
- a vertical direction, defined by a plane which passes via the plane S and is perpendicular to X.

Nose (Also Known as the Tip Guide)

An aspect of the present disclosure concerns the nose 9 of the tool 1. The nose 9 is configured to fire a B/B nail 6*a* and a M/B nail 6*b*. The nose 9 thus comprises a B/B location 79*a* (FIG. 6) in which the B/B nail 6*a* is placed before being fired, and an M/B location 79*b* (FIG. 10) in which the M/B nail 6*b* is placed before being fired, the B/B location 79*a* being distinct from the M/B location 79*b*.

The nose 9 is symmetrical according to the plane S. The nose 9 delimits partly a firing chamber 7, and comprises a first support area 31*a* (known as the B/B support area) that can cooperate with the head 5*a* of the B/B nail 6*a* for the purpose of its positioning before firing (FIG. 6). The nose 9 comprises a second support area 31*b* (known as the M/B support area) that is spaced longitudinally from the first area 31*a*, and can cooperate with a head 5*b* of the M/B nail 6*b* for the purpose of its positioning before firing (FIG. 10).

According to the embodiment illustrated in the figures, the nose 9 comprises a base 32 for fixing on the fixed part of the drive device 3, and a protuberance 33 (or beak) that is oriented according to the axis X, with this protuberance 33 thinning from the base 32.

Figure 5:
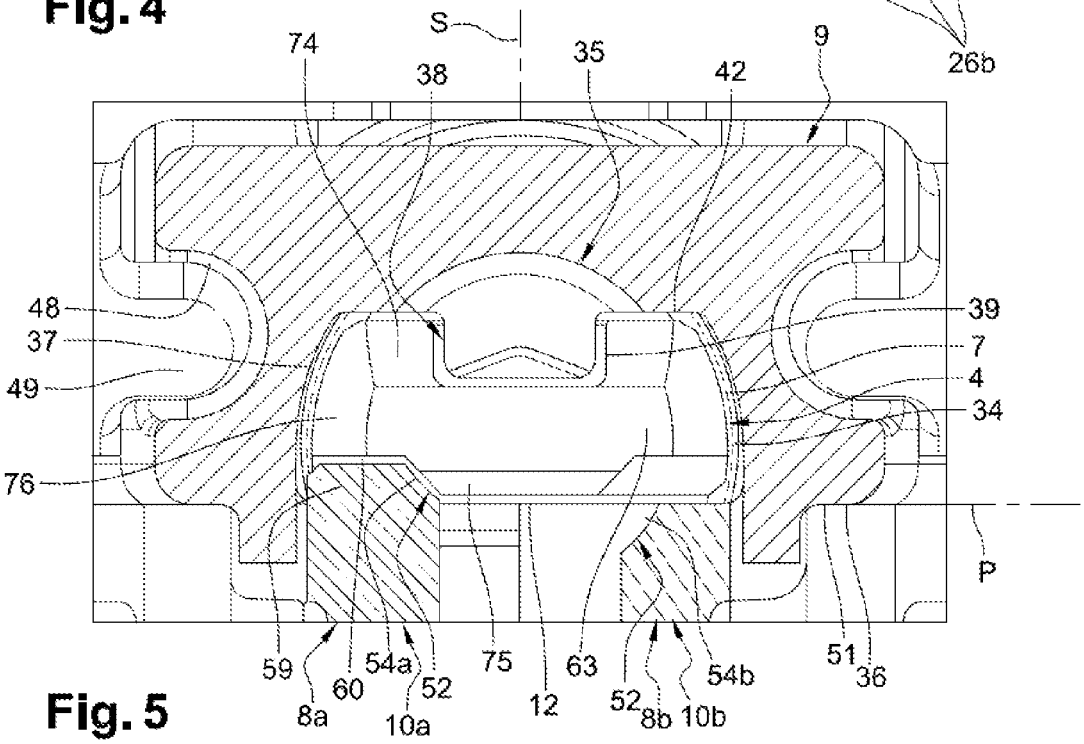
FIG. 5 is a view juxtaposing two transverse half cross-sections of a firing chamber of the fixing tool (i.e., the left part with a store configured for the first type of nail and the right part with a store configured for the second type of nail)

As illustrated in FIG. 5, the nose 9 comprises in its inside a cavity 34 that extends according to the axis X, and partly forms the firing chamber 7. The cavity 34 is delimited vertically by an upper wall 35, and opens at the bottom on to a flat surface 36 for joining with the shearing block 10*a* or 10*b*. The cavity is delimited laterally by two concave edges 37, with the cavity 34 widening from the upper wall 35 as far as the flat surface 36.

As illustrated in FIGS. 6, 8, 10 and 12, the upper wall 35 is stepped, and defines the B/B 31*a* and M/B 31*b* support areas, with the M/B support area 31*b* being slightly raised relative to the B/B support area 31*a*. The B/B 31*a* and M/B 31*b* support areas are aligned according to an axis of extension of the wall 35, and in other words according to the axis X.

As illustrated in particular in FIG. 5, the wall 35 comprises a rim 38 (or lug) projecting vertically into the chamber 7, and centered relative to the plane S, this rim 38 having a rectangular form in transverse cross-section. The rim 38 extends longitudinally from the base 32 of the nose 9, and can engage in a groove 39 in the plate 4.

As illustrated in particular in FIG. 6, the rim 38 defines the B/B support area 31*a*.

Figure 7:
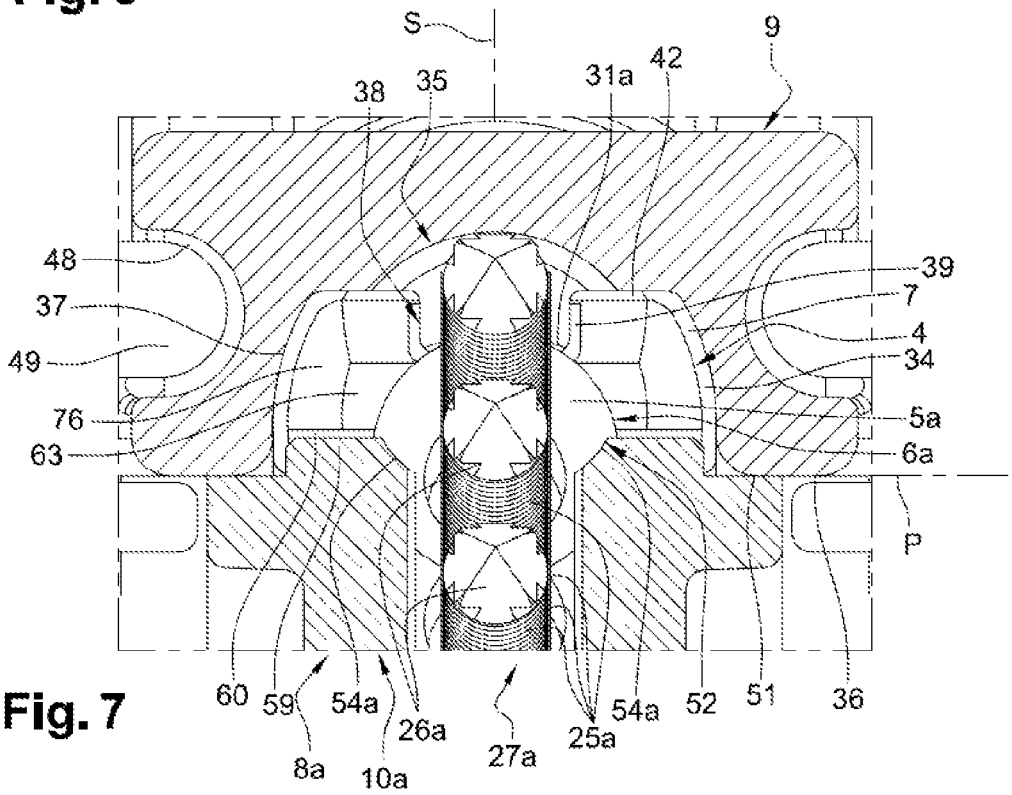

The support areas 31*a* or 31*b* are concave, and more specifically cylindrical. As illustrated in FIG. 7, the B/B support area 31*a* has a radius which is substantially equal to that of the head 5*a* of the B/B nail 6*a*, such as to position the head 5*a* precisely in the firing chamber 7. In the same manner, the M/B support area 31*b* has a radius which is substantially equal to that of the head 5*b* of the M/B nail 6*b*.

The B/B 31*a* and M/B 31*b* support areas are connected longitudinally via a sloping connection area 40. The B/B support area 31*a* is prolonged such as to extend from a rear stop as far as the connection area 40. The M/B support area 31*b* is prolonged such as to extend from the connection area 40 as far as the mouth 11 of the firing chamber 7.

As illustrated in FIG. 7, each lateral edge 37 of the cavity 34 is connected to the rim 38 and to the M/B support area 31*b* via a substantially horizontal flat indentation 42.

Figure 2:
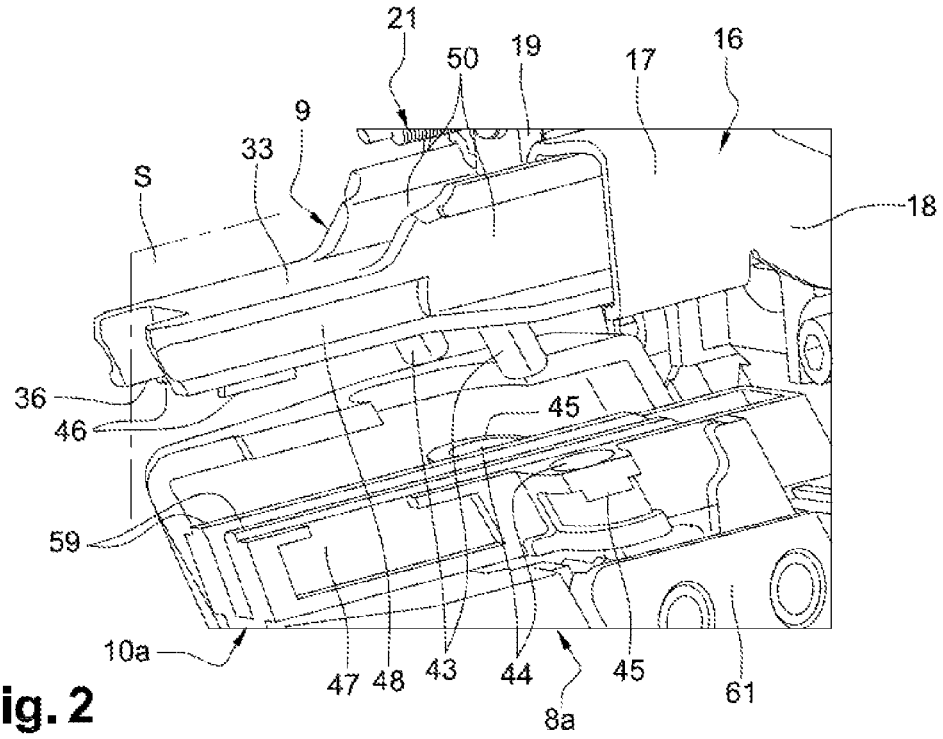
FIG. 2 is a detailed view of FIG. 1.

As illustrated in FIG. 2, the nose 9 also comprises two studs 43 that project from the flat surface 36, positioned on both sides of the cavity 34, each of them being able to engage in a bore 44 with a complementary form provided in an ear 45 of the shearing block 10*a* or 10*b*. The nose 9 also comprises two teeth 46 that project from the flat surface 36. The teeth 46 extend longitudinally, and are positioned on both sides of the cavity 34, with each tooth 46 being able to engage in a notch 47 provided in the shearing block 10*a* or 10*b*. The studs 43 and the teeth 46 make it possible to carry out the positioning of the shearing block 10*a* or 10*b* (and the store 8*a* or 8*b*) relative to the nose 9.

As illustrated in particular in FIGS. 2 and 5, in the front part the nose 9 comprises a guide duct 48 that extends longitudinally on each of the lateral parts of the nose 9, with each of the ducts 48 being able to receive a lip 49 projecting from the sensor 15*a* or 15*b* in order to permit the guiding in translation of the latter on the nose 9 of the tool 1.

As illustrated in FIG. 2, in the rear part the nose 9 comprises a guide rail comprising two borders 50 in the form of a "U", with each of them bordering the nose 9 and facing towards the exterior. The head 17 of the armature 16 of the sensor assembly is fitted such as to be mobile in translation on the rail of the nose 9.

Shearing Block (Also Known as the "Connector")

An aspect of the present disclosure concerns the shearing block 10*a* or 10*b* of the store 8*a* or 8*b*, respectively. It will be remembered that, according to the embodiment illustrated in the figures, depending on the type of nail 6*a* or 6*b* to be fired, the user fits the B/B store 8*a* or the M/B store 8*b* on the nose 9 of the tool 1.

A shearing block 10*a* or 10*b* is symmetrical according to the plane S, and delimits the bottom part of the firing chamber 7. The shearing block 10*a* or 10*b* comprises a flat surface 51 for joining with the nose 9. The shearing block 10*a* or 10*b* comprises a central window 12 for supply to the chamber 7, with the window 12 extending according to the axis X, and opening into the firing chamber 7.

The shearing block 10*a* or 10*b* additionally comprises at least one track 52 and 53 for guiding the corresponding nail 6*a* or 6*b*, with the track 52 and 53 being opposite the B/B 31*a* and M/B 31*b* support areas of the nose 9. The guide track 52 and 53 is formed by two notches 54*a* or 54*b* for guiding the head 5*a* or 5*b* of the corresponding nail 6*a* or 6*b*, with the notches 54*a* or 54*b* being opposite one another and partly bordering the window 12.

According to the embodiment illustrated in the figures, the window 12 is substantially in the form of a "T", and comprises a rear opening 56 for passage of the heads 5*a* or 5*b* of nails 6*a* or 6*b* into the firing chamber 7, and a front opening 57 for passage of the shanks 25*a* or 25*b* of nails 6*a* or 6*b* into the firing chamber 7.

As illustrated in FIGS. 6, 8, 10 and 12, the shearing block 10*a* or 10*b* comprises an inclined rear track 53 (which can be assimilated to a launching ramp), with this rear track 53 rising from a threshold 58 situated in the vicinity of the rear opening 56, as far as an intersection with a front track 52. The front track 52 is substantially straight, and extends longitudinally from the intersection with the rear track 53, as far as the mouth 11 of the firing chamber 7.

As illustrated in particular in FIGS. 9 and 13, the front notches 54*a* or 54*b* of the front track 52 are positioned in the firing chamber 7, and have dimensions such that, during the firing, the head 5*a* or 5*b* of the nail 6*a* or 6*b* fired is guided such that it (and in particular its head 5*a* or 5*b*) does not come into contact with the nail 6*a* or 6*b* situated just below. The front notches 54 are longitudinal and symmetrical relative to the plane S. The front notches 54*a* or 54*b* are concave, and more specifically cylindrical. The front notches 54*a* or 54*b* have a radius which is substantially equal to that of the head 5*a* or 5*b* of the corresponding nail 6*a* or 6*b*.

Figure 9:
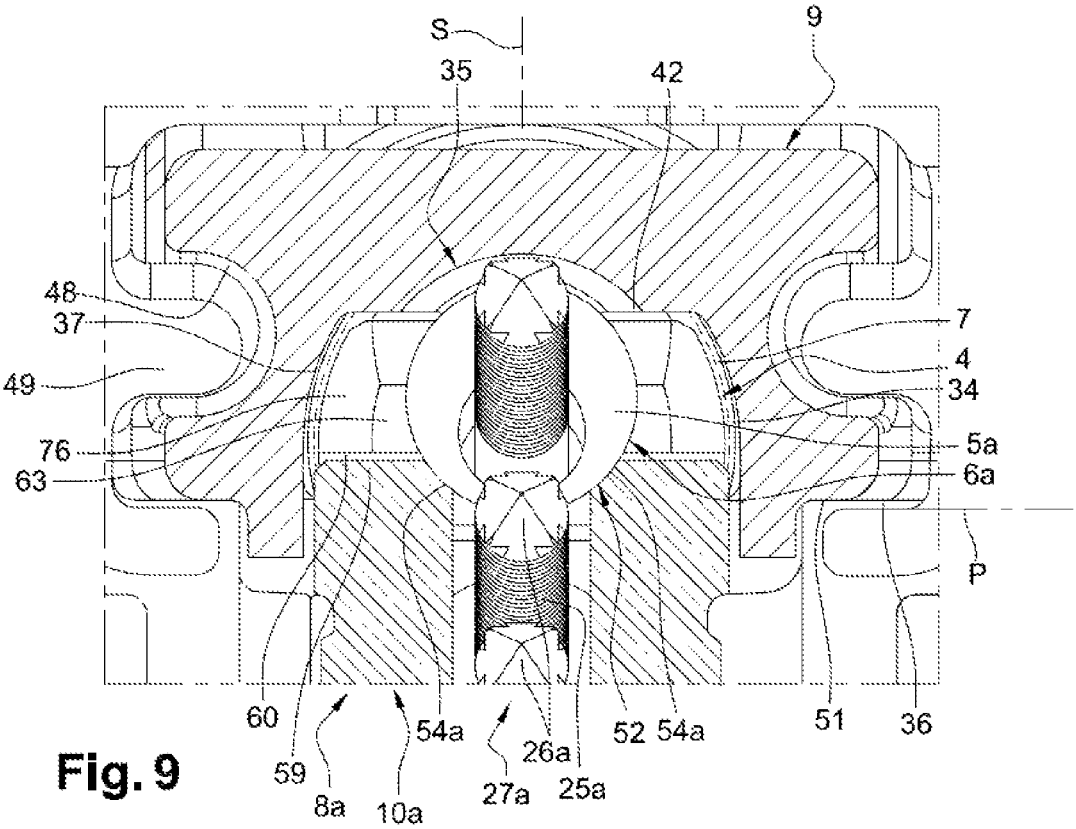

As illustrated in FIGS. 7 and 9, in association with the B/B shearing block 10*a*, the front notches 54*a* are each formed in a tongue 59 projecting from the flat surface 51 and extending according to the axis X, with the tongues 59 then projecting inside the firing chamber 7. Each tongue 59 can engage in a recess 60 with a complementary form provided in the plate 4. During the firing, the rear track 53 makes it possible in particular to place the head 5*a* of the B/B nail 6*a* in the top part of the firing chamber 7. In the fitted position, the rear opening 56 is vertically opposite the M/B support area 31*b*, and the rear track 53 is vertically opposite the connection area 40.

Figure 11:
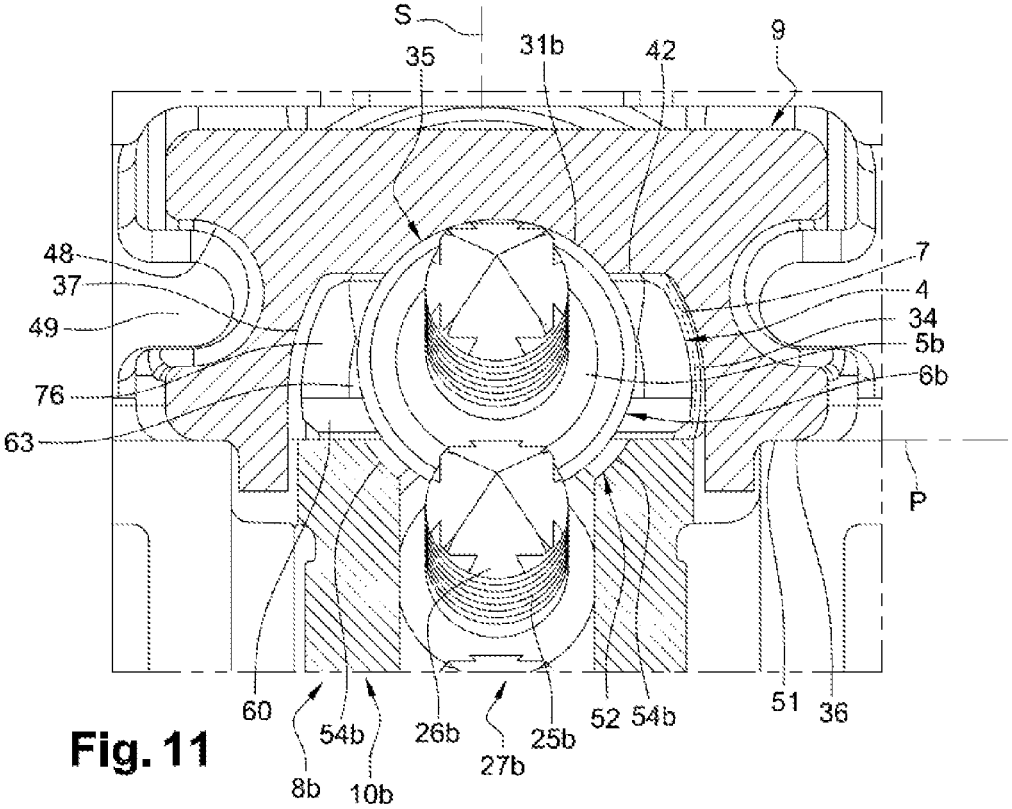
Figure 13:
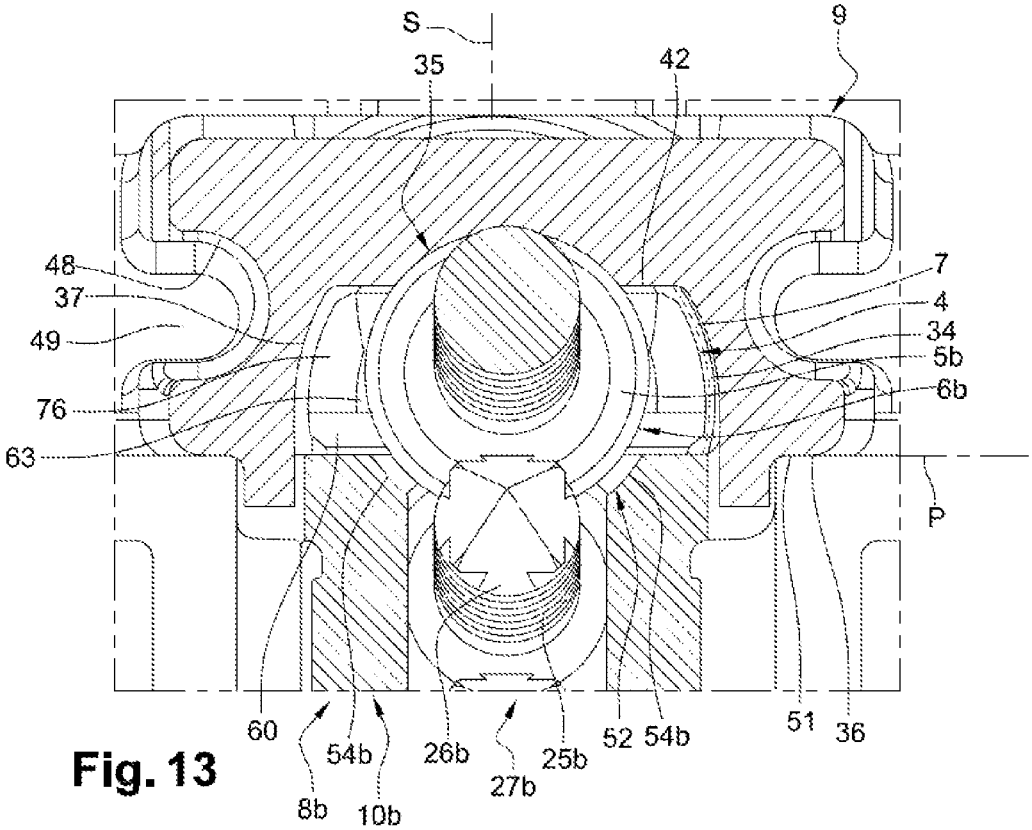

As illustrated in FIGS. 11 and 13, in association with the M/B shearing block 10*b*, the front notches 54*b* are each formed flush with the flat surface 51.

As illustrated in FIGS. 5, 7, 9, 11 and 13, when the store 8*a* or 8*b* is fitted on the tool 1, the nose 9 and the shearing block 10*a* or 10*b* are fitted supported according to a joining plane P, with the flat surfaces 36, 51 of the nose 9 and of the shearing block 10*a* or 10*b* being in contact.

The store 8*a* or 8*b* is maintained in position by way of a tightening knob (not shown). The refills 26*a* or 26*b* of nails 6*a* or 6*b* are introduced into the store 8*a* or 8*b* through a slot (not shown) which is provided in the bottom part. A lift 61 makes it possible to raise the refill 26*a* or 26*b* after each firing, and in other words to refill the chamber 7 after each firing.

As illustrated in FIG. 6, before being fired, the head 5*a* of the B/B nail 6*a* is supported on the B/B support area 31*a* of the nose 9, and the shank 25*a* in the vicinity of the tip 26*a* of the B/B nail 6*a* is supported on the upper wall 35 of the nose 9 (or close to the upper wall 35). The B/B nail 6*a* is then inclined in the firing chamber 7 by approximately ten degrees relative to the longitudinal direction (eight degrees in the example illustrated).

In the same manner, as illustrated in FIG. 10, before being fired, the head 5*b* of the M/B nail 6*b* is supported on the M/B support area 31*b* of the nose 9, and the shank 25*b* in the vicinity of the tip 26*b* of the M/B nail 6*b* is supported on the upper wall 35 of the nose 9 (or close to the upper wall 35). The M/B nail 6*b* is then inclined in the firing chamber 7 by a few degrees relative to the longitudinal direction (three degrees in the example illustrated).

Striking Plate

An aspect of the present disclosure concerns the plate 4 of the tool 1. The striking plate 4 is configured to fire a B/B nail 6*a* and an M/B nail 6*b*. The striking plate 4 comprises a striking surface 63 that is configured to strike the nails 6*a* or 6*b* placed in their respective locations 79*a* or 79*b*.

The striking plate 4 has a generally elongate form, and is symmetrical according to the plane S, the plate 4 comprising:

- mechanisms for securing on the mobile part of the drive device 3, which are situated at a first longitudinal end, known as the rear end 62;
- the surface 63 for striking the heads 5*a* or 5*b* of B/B 6*a* and M/B 6*b* nails, with the striking surface 63 being situated at a second longitudinal end, known as the front end 64, opposite the rear end 62; and
- an elongate body 65 situated between the rear end 62 and the front end 64, with the body 65 being able to slide in the firing chamber 7 in which the nail 6*a* or 6*b* to be struck is located.

The body 65 also comprises a longitudinal groove 39 that can receive the rim 38 of the nose 9.

Figure 14:
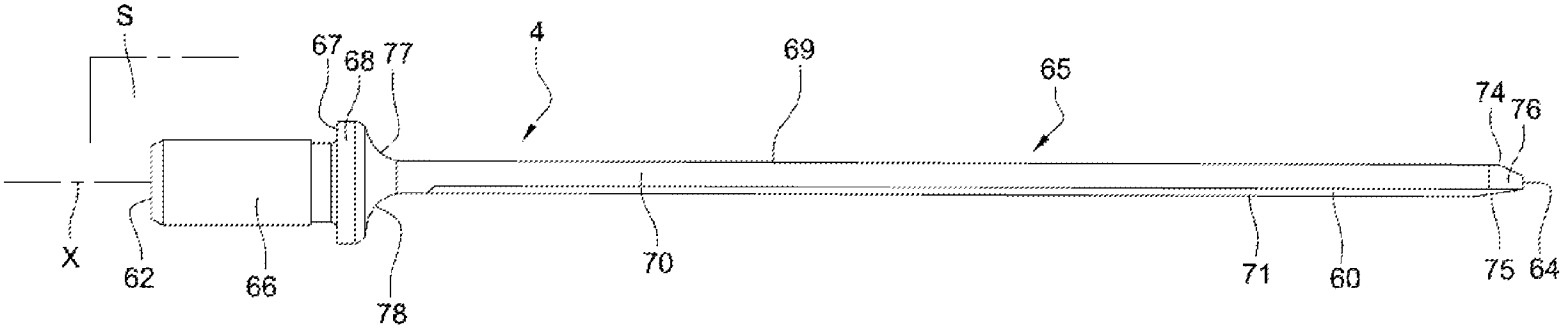
FIG. 14 is a side view of a plate of the fixing tool.
Figure 15:
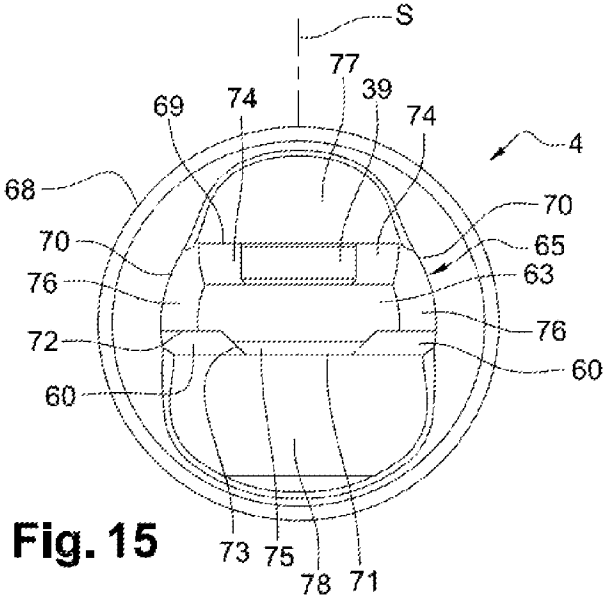
FIG. 15 is a front view of the plate in FIG. 14.

According to the embodiment illustrated in particular in FIGS. 14 and 15, in this case the fixing mechanisms correspond to a threaded stub 66 which extends from the rear end 62 as far as a shoulder 67 provided in a flange 68 which separates the stud 66 from the body 65 of the plate 4.

The groove 39 extends longitudinally, and has a form complementary to the rim 38 of the nose 9 (i.e., it is rectangular in transverse cross-section). The groove 39 is centered relative to the said plane S on an upper face 69 of the plate 4, and extends longitudinally from a position near the first longitudinal end toward and through is flush with the striking surface 63 at the second longitudinal end.

The body 65 is delimited laterally by two concave flanks 70 with a form complementary to the lateral edges 37 of the cavity 34. In transverse cross-section, laterally, the plate 4 widens from the upper surface 69 as far as a lower face 71 which is vertically opposite the upper face 69.

The body 65 comprises two longitudinal recesses 60 opposite the groove 39, with each recess 60 being able to receive a tongue 59 of the B/B shearing block 10*a*. Each recess 60 thus has a form complementary to a tongue 59 of the shearing block 10*a* (i.e., it is substantially rectangular). Each recess 60 opens at once onto a flank 70, the lower face 71, and the striking surface 63. The body 65 thus has a profile in the form of a "V" in transverse cross-section. Each recess 60 has a substantially horizontal upper edge 72 (perpendicular to the plane S) and an inclined lateral edge 73 that extends from the upper edge 72 and in the direction of the plane S.

In the vicinity of its front end 64, the body 65 has a reduction of cross-section, and more specifically:

- two upper chamfers 74 arranged on both sides of the groove 39, with each chamfer 74 connecting the upper face 69 to the striking surface 63;
- a lower chamfer 75 that connects the lower face 71 to the striking surface 63; and
- two convex cheeks 76 arranged on both sides of the striking surface 63, with each cheek 76 connecting a flank 70 to the striking surface 63.

The striking surface 63 is flat and has a profile in the form of a "T" (FIG. 15).

The plate 4 additionally comprises an upper necking 77 for connection of the flange 68 to the upper face 69 of the body 65, and a lower necking 78 for connection of the flange 68 to the lower face 71 of the body 65.

The plate 4 has mechanical properties that enable it to withstand mechanically the repeated firing of B/B 6*a* and/or M/B 6*b* nails. The striking surface 63 in particular has high strength in order to retain its geometric characteristics (and in particular its levelness) and its dimensional characteristics blow after blow.

As illustrated in FIGS. 6 to 9, when a B/B nail 6*a* is fired, the striking surface 63 of the plate 4 strikes the bare portion of the head 5*a* of the B/B nail 6*a* (present in the firing chamber 7), such that the plate 4 does not drive two superimposed B/B 6*a* nails simultaneously. After the striking, the head 5*a* of the B/B nail 6*a* is re-centered relative to the striking surface 63 of the plate 4 via the rear track 53, with this re-centering enabling the plate 4 to exert a thrust on the center of the head 5*a* of the B/B nail 6*a*, when the latter is on the front track 52. The trajectory of the B/B nail 6*a* is then stabilised on the front track 52, such as to impart to the B/B nail 6*a* fired a substantially longitudinal trajectory at the output from the mouth 11, and in other words a trajectory which coincides with the direction of the plate 4.

As illustrated in FIGS. 10 to 13, when a M/B nail 6*b* is fired, the striking surface 63 of the plate 4 strikes the head 5*a* of the M/B nail 6*b* in its center. After the striking, the trajectory of the M/B nail 6*b* is stabilised on the front track 52, such as to impart to the M/B nail 6*b* fired a substantially longitudinal trajectory at the output from the mouth 11, and in other words a trajectory which coincides with the direction of the plate 4.

The embodiment illustrated in the figures is in no way limiting, and this fixing tool 1 could be configured to drive staples, tacks, pins, etc.

It will be understood that modifications and variations may be effected without departing from the scope of the novel concepts of the present invention, and it is understood that this application is to be limited only by the scope of the claims.

The invention claimed is:

1. A nose for a fixing tool and for guiding of fixing elements provided from a supply store of the fixing tool, the nose comprising:

- a stepped wall having a first portion configured to be contacted by a first head of a first fixing element of a first type to position the first head before firing and a second portion configured to be contacted by a second head of a second fixing element of a second type to position the second head before firing, the second fixing element of the second type having one or more dimensional and/or geometric characteristics different from those of the first fixing element of the first type, wherein the first portion is closer to a part of the supply store than the second portion;
- a first support area configured to receive the first head of the first fixing element of the first type before firing, the first support area being partially defined by the first portion of the stepped wall; and
- a second support area that is spaced from the first support area, the second support area configured to receive the second head of the second fixing element of the second type before firing, the second support area being partially defined by the second portion of the stepped wall.

2. The nose of claim 1, which partly defines a firing chamber of the fixing tool.

3. The nose of claim 2, wherein the first support area and the second support area are aligned according to an axis of extension of the stepped wall.

4. The nose of claim 3, which includes a rim engagable in a groove defined by a striking plate of the fixing tool.

5. A fixing tool comprising:

a supply store configured to hold a plurality of fixing elements to be fired, the plurality of fixing elements including a first fixing element of a first type and a second fixing element of a second type, wherein the second fixing element of the second type has one or more dimensional and/or geometric characteristics different from those of the first fixing element of the first type;

a nose configured to receive the first and the second fixing elements from the supply store, the nose partly defining a firing chamber; and a striking plate configured to strike each of the first and the second fixing elements after that fixing element is received in the nose;

wherein the nose includes a stepped wall having a first portion configured to be contacted by a first head of the first fixing element of the first type to position the first head before firing and a second portion configured to be contacted by a second head of the second fixing element of the second type to position the second head before firing, wherein the first portion is closer to a part of the supply store than the second portion;

wherein the nose further includes: (i) a first support area configured to receive the first head of the first fixing element of the first type before firing, the first support area being partially defined by the first portion of the stepped wall; (ii) a second support area that is spaced from the first support area and configured to receive the second head of the second fixing element before firing, the second support area being partially defined by the second portion of the stepped wall; and (iii) a rim;

wherein the striking plate defines a groove, the groove being configured to receive the rim of the nose.

6. The fixing tool of claim 5, which includes a shearing block supported on the nose along a joining plane, wherein the shearing block defines a guide track for the first fixing element and/or the second fixing element, the guide track being opposite the first support area and the second support area.

7. The fixing tool of claim 6, wherein the shearing block defines a central window extending along a longitudinal axis (X) of the nose.

8. The fixing tool of claim 7, wherein the shearing block defines two notches that define the guide track, the notches being opposite one another relative to a longitudinal plane of the shearing block and at least partially bordering the window.

9. The fixing tool of claim 6, wherein the shearing block defines a part of the firing chamber opposite to the part of the firing chamber defined by the nose relative to a plane perpendicular to the longitudinal plane.

10. The fixing tool of claim 6, which includes a workpiece surface sensor assembly, the sensor assembly being mobile in translation relative to the nose along a longitudinal axis extending from the nose.

11. A fixing tool comprising:

a supply store configured to hold a plurality of fixing elements to be fired, the plurality of fixing elements including a first fixing element of a first type and a second fixing element of a second type, wherein the second fixing element of the second type has one or more dimensional and/or geometric characteristics different from those of the first fixing element of the first type; and a nose configured to receive the first and the second fixing elements from the supply store, the nose partially defining a firing chamber;

wherein the nose includes a stepped wall having a first portion configured to be contacted by a first head of the first fixing element of the first type to position the first head before firing and a second portion configured to be contacted by a second head of the second fixing element of the second type to position the second head before firing, wherein the first portion is closer to a part of the supply store than the second portion;

wherein the nose further includes a first support area and a second support area, the first support area being configured to receive the first head of the first fixing element of the first type before firing, the second support area being spaced from the first support area and configured to receive the second head of the second fixing element before firing, wherein the first support area is partially defined by the first portion of the stepped wall and the second support area is partially defined by the second portion of the stepped wall.

12. A striking plate for a fixing tool and configured to drive a first fixing element of a first type and a second fixing element of a second type with one or more dimensional and/or geometric characteristics different from those of the first fixing element of the first type, the striking plate comprising:

a striking surface at a first longitudinal end, the striking surface configured to strike a first head of the first fixing element at a first location of a nose of the fixing tool and to strike a second head of the second fixing element at a second location of the nose;

a drive device fixing mechanism at a second longitudinal end opposite the first longitudinal end; and an elongated body between the first and the second longitudinal ends, the body configured to be slidable in a firing chamber in which the first fixing element or the second fixing element is located, wherein the body defines a longitudinal groove configured to receive a rim of a nose of the fixing tool, the groove being positioned such that it is centered relative to a longitudinal plane on an upper face of the body and extends longitudinally from a position near the second longitudinal end toward and through the striking surface at the first longitudinal end;

wherein the striking plate is symmetrical along the longitudinal plane.

13. The striking plate of claim 12, which plate defines a first recess and a second recess each disposed on a lower face of the body opposite the upper face in which the groove is disposed, the first recess being disposed on a side of the longitudinal plane and the second recess being disposed on a side of the longitudinal plane opposite the first recess, wherein the first recess and the second recess are configured to receive a tongue projecting from a shearing block of the fixing tool.

14. The striking plate of claim 13, wherein each of the first and the second recesses are adjacent to both: (i) a flank of the body located on each side of the longitudinal plane, respectively, and (ii) the striking surface.

15. A fixing tool comprising:

a supply store configured to hold a plurality of fixing elements to be fired, the plurality of fixing elements including a first fixing element of a first type and a second fixing element of a second type, wherein the second fixing element of the second type has one or more dimensional and/or geometric characteristics different from those of the first fixing element of the first type;

a nose configured to receive the first and the second fixing elements from the supply store, the nose partially defining a firing chamber;

a shearing block; and a striking plate configured to strike each of the first and the second fixing elements after that fixing element is received in the nose;

wherein the striking plate is symmetrical along a longitudinal plane and includes: (i) a striking surface at a first longitudinal end, the striking surface configured to strike a first head of the first fixing element in a first location of the nose and to strike a second head of the second fixing element in a second location of the nose, (ii) a drive device fixing mechanism at a second longitudinal end opposite the first longitudinal end, and (iii) an elongated body between the first and the second longitudinal ends and configured to be slidable in the firing chamber in which the first fixing element or the second fixing element is located;

wherein the body defines a longitudinal groove configured to receive a rim of the nose, the groove being positioned such that it is centered relative to the longitudinal plane on an upper face of the body and extends longitudinally from a position near the first longitudinal end toward and through the striking surface at the second longitudinal end;

wherein the body further defines a first recess and a second recess each disposed on an upper face of the body opposite the lower face in which the groove is disposed and configured to receive a tongue projecting from the shearing block, the first recess being disposed on a side of the longitudinal plane and the second recess being disposed on a side of the longitudinal plane opposite the first recess, wherein each of the first and the second recesses are adjacent to both: (i) a flank of the body located on each side of the longitudinal plane, respectively, and (ii) the striking surface.

16. The fixing tool of claim 15, wherein the striking plate is mobile in translation relative to the nose along a longitudinal axis extending from the nose.

17. The fixing tool of claim 15, wherein the shearing block defines a part of the firing chamber opposite to the part of the firing chamber defined by the nose relative to a plane perpendicular to the longitudinal plane.

18. The fixing tool of claim 15, which includes a workpiece surface sensor assembly, the sensor assembly being mobile in translation relative to the nose along a longitudinal axis extending from the nose.

* * * * *